US009362649B2

(12) United States Patent
Itou

(10) Patent No.: US 9,362,649 B2
(45) Date of Patent: Jun. 7, 2016

(54) ELECTRIC CONNECTOR

(71) Applicant: Japan Aviation Electronics Industry, Ltd., Tokyo (JP)

(72) Inventor: Yasukazu Itou, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 14/424,258

(22) PCT Filed: Jun. 21, 2013

(86) PCT No.: PCT/JP2013/003898

§ 371 (c)(1),
(2) Date: Feb. 26, 2015

(87) PCT Pub. No.: WO2014/038114

PCT Pub. Date: Mar. 13, 2014

(65) Prior Publication Data

US 2015/0229059 A1 Aug. 13, 2015

(30) Foreign Application Priority Data

Sep. 5, 2012 (JP) ..... 2012-195355

(51) Int. Cl.
*H01R 13/42* (2006.01)
*H01R 13/41* (2006.01)
(Continued)

(52) U.S. Cl.
CPC ..... *H01R 13/42* (2013.01); *H01R 11/283* (2013.01); *H01R 11/287* (2013.01); *H01R 13/41* (2013.01); *H01R 13/4223* (2013.01); *H01R 13/6271* (2013.01)

(58) Field of Classification Search
CPC .... H01R 13/42; H01R 11/283; H01R 11/287; H01R 13/41; H01R 13/4223; H01R 13/6271; H01R 11/281; H01R 11/285; H01R 11/286; H01R 11/289
USPC ..... 439/733.1, 758, 500, 754
See application file for complete search history.

(56) References Cited

U.S. PATENT DOCUMENTS 2,431,215 A * 11/1947 Viljoen ..... H01R 11/283 439/758
6,062,901 A * 5/2000 Liu ..... H01M 2/1044 429/100

(Continued)

FOREIGN PATENT DOCUMENTS

CN 101542848 A 9/2009
JP 06-084511 A 3/1994

(Continued)

OTHER PUBLICATIONS

International Search Report dated Sep. 3, 2013 from corresponding Int'l Application No. PCT/EP2013/003898; 2 pgs.

(Continued)

*Primary Examiner* — Abdullah Riyami
*Assistant Examiner* — Nelson R Burgos-Guntin
(74) *Attorney, Agent, or Firm* — Maier & Maier, PLLC

(57) ABSTRACT

A receptacle connector includes a receptacle contact capable of coming into contact with a receptacle contact of a plug connector, and a receptacle housing having a contact insertion hole into which the receptacle contact is inserted. The receptacle contact includes a held portion that is accommodated in the contact insertion hole and is held by the receptacle housing, and an orthogonal portion projecting in a direction substantially orthogonal to an insertion direction. The orthogonal portion has a bolt hole formed therein. The receptacle connector further includes a displacement regulating mechanism that regulates displacement of a proximal end portion relative to the receptacle housing in a width center direction.

8 Claims, 17 Drawing Sheets

(51) Int. Cl.

| | |
|---|---|
| ***H01R 13/422*** | (2006.01) |
| ***H01R 11/28*** | (2006.01) |
| *H01R 13/627* | (2006.01) |

(56) References Cited

U.S. PATENT DOCUMENTS

| | | | | |
|---|---|---|---|---|
| 6,087,037 | A * | 7/2000 | Rieder | H01M 2/1044 429/100 |
| 7,749,030 | B1 * | 7/2010 | Smith | H01R 11/282 439/754 |
| 2002/0051906 | A1 * | 5/2002 | Wakata | G01R 31/3696 429/178 |
| 2003/0064634 | A1 * | 4/2003 | Fukuda | H01R 11/282 439/754 |
| 2005/0008929 | A1 | 1/2005 | Brede et al. | |
| 2006/0057899 | A1 * | 3/2006 | Tokunaga | H01M 10/48 439/754 |
| 2007/0207652 | A1 * | 9/2007 | Tsuruta | H01R 4/30 439/166 |
| 2010/0247979 | A1 * | 9/2010 | Ha | H01M 2/1077 429/7 |
| 2010/0316901 | A1 * | 12/2010 | Matsushima | G01R 31/3696 429/121 |
| 2010/0317242 | A1 * | 12/2010 | Kim | H01R 11/284 439/754 |
| 2011/0050240 | A1 * | 3/2011 | Nentwig | G01R 31/3696 324/437 |
| 2013/0040177 | A1 * | 2/2013 | Hashio | H01M 2/305 429/93 |
| 2014/0322989 | A1 * | 10/2014 | Kaneko | H01R 4/34 439/723 |
| 2015/0229059 | A1 * | 8/2015 | Itou | H01R 11/283 439/733.1 |
| 2015/0280336 | A1 * | 10/2015 | Itou | H01M 2/30 439/625 |

FOREIGN PATENT DOCUMENTS

| | | | |
|---|---|---|---|
| JP | 2004227999 | A | 8/2004 |
| JP | 2009254072 | A | 10/2009 |
| JP | 2010102977 | A | 5/2010 |
| JP | 2010140805 | A | 6/2010 |

OTHER PUBLICATIONS

Chinese Office Action dated Mar. 4, 2016, in connection with corresponding CN Application No. 201380041620.3 (17 pgs., including English translation).

* cited by examiner

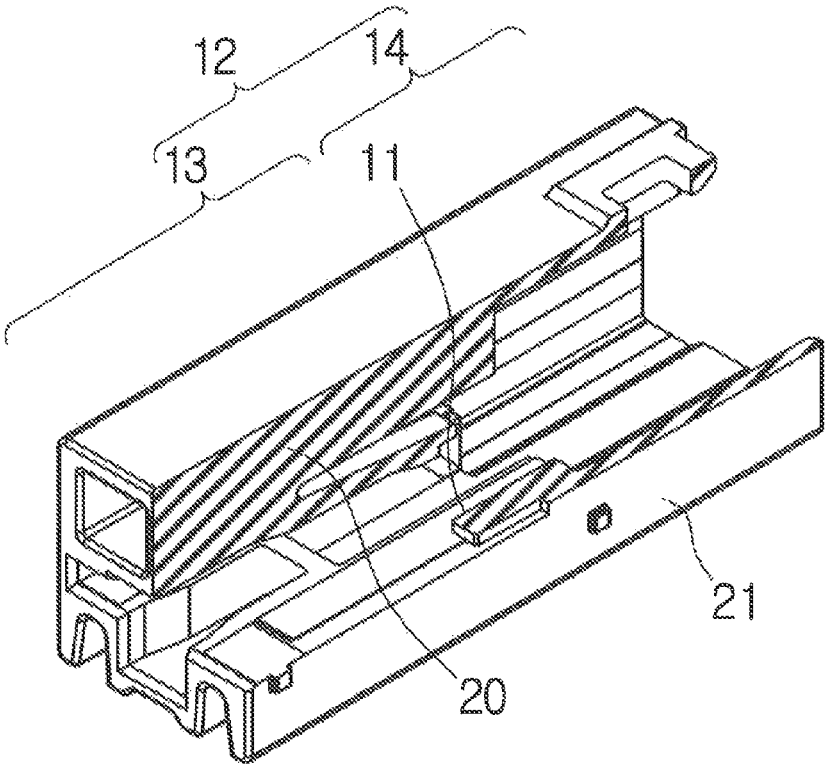
Fig. 4
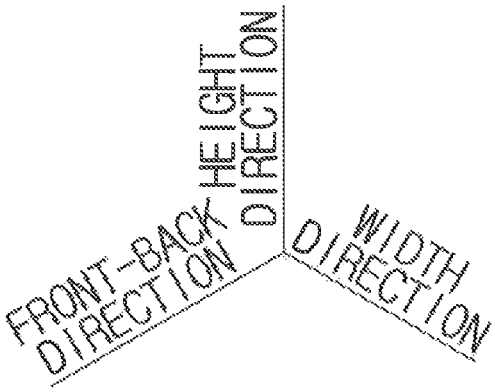

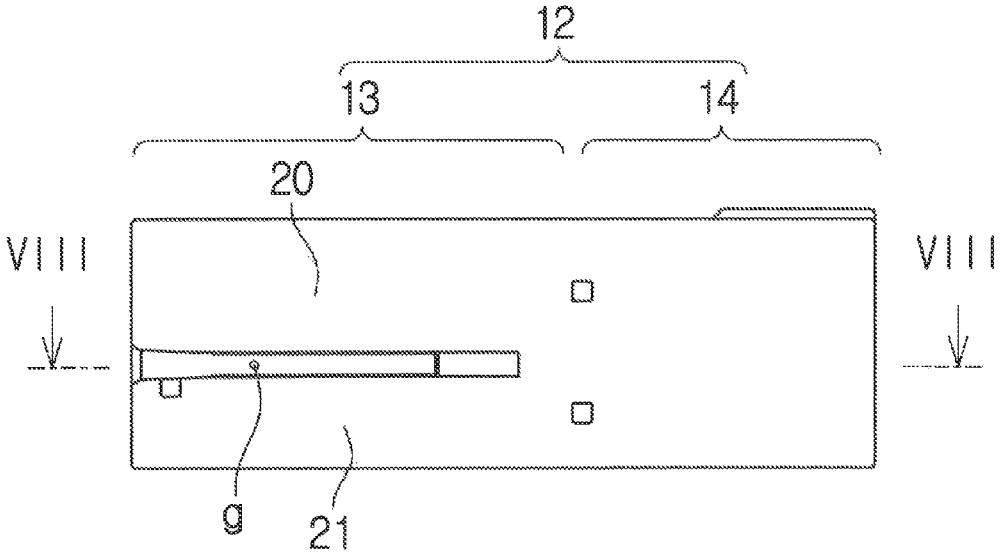
Fig. 6
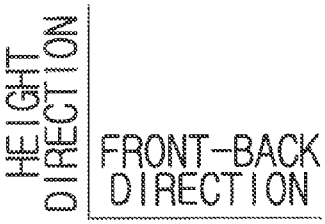

ELECTRIC CONNECTOR

TECHNICAL FIELD

The present invention relates to an electric connector.

BACKGROUND ART

As a technique of this type, Patent Literature 1 discloses a structure in which a bus bar 102, which is formed in a substantially L-shape, is connected to a battery post 101 of an on-vehicle battery 100 as shown in FIG. 17 of the present application. The bus bar 102 is connected to a cable 103.

CITATION LIST

Patent Literature

[Patent Literature 1] Japanese Unexamined Patent Application Publication No. H06-84511

SUMMARY OF INVENTION

Technical Problem

Incidentally, the inventor of the present application has developed an electric connector which includes a contact capable of coming into contact with a mating contact of a mating connector, and a housing having a contact insertion hole into which the contact is inserted. In the electric connector, the contact is held by the housing when the contact is inserted into the contact insertion hole. In this case, when the contact is screwed on a terminal of a battery, for example, the contact may undesirably rotate relative to the housing.

It is an object of the present invention to provide a technique for preventing the contact from rotating relative to the housing during screwing.

Solution to Problem

According to an aspect of the present invention, an electric connector is provided, including: a contact capable of coming into contact with a mating contact of a mating connector; and a housing having a contact insertion hole into which the contact is inserted, the contact being held by the housing when the contact is inserted into the contact insertion hole. The contact includes: a held portion that is accommodated in the contact insertion hole and is held by the housing; a distal end portion projecting from the held portion in an insertion direction in which the contact is inserted into the contact insertion hole, the distal end portion being capable of coming into contact with the mating contact of the mating connector; a proximal end portion projecting from the held portion in a direction opposite to the insertion direction; and an orthogonal portion projecting from the proximal end portion in a direction substantially orthogonal to the insertion direction. The orthogonal portion has a bolt hole for bolting. The electric connector further includes a displacement regulating mechanism that regulates displacement of the proximal end portion relative to the housing in a direction different from the insertion direction.

The displacement regulating mechanism regulates displacement of the proximal end portion relative to the housing in a direction substantially orthogonal to the insertion direction.

The contact includes an interference portion projecting from the proximal end portion. The housing includes a regulating portion that receives the interference portion when the interference portion is to be displaced relative to the housing in a direction substantially orthogonal to the insertion direction. The interference portion and the regulating portion form the displacement regulating mechanism.

The interference portion is disposed opposite to the held portion with the proximal end portion interposed therebetween.

The housing has an interference portion insertion groove in which the interference portion is inserted. An inner wall surface of the interference portion insertion groove functions as the regulating portion.

The interference portion is press-fit into the interference portion insertion groove.

The held portion is press-fit into the contact insertion hole, thereby being held by the housing.

The housing includes a lance that prevents removal of the contact. A lance locking surface is formed on the held portion of the contact, the lance being caught on the lance locking surface. As the lance is caught on the lance locking surface, holding of the held portion by the housing is allowed.

Advantageous Effects of Invention

According to the present invention, a rotation of a contact relative to a housing can be prevented during screwing.

BRIEF DESCRIPTION OF DRAWINGS

FIG. 4 is a partially cutaway perspective view of a receptacle housing (first embodiment);

FIG. 6 is a front view of the receptacle housing (first embodiment);

DESCRIPTION OF EMBODIMENTS (First Embodiment)

A first embodiment of the present invention will be described below with reference to FIGS. 1 to 14.

Figure 1:
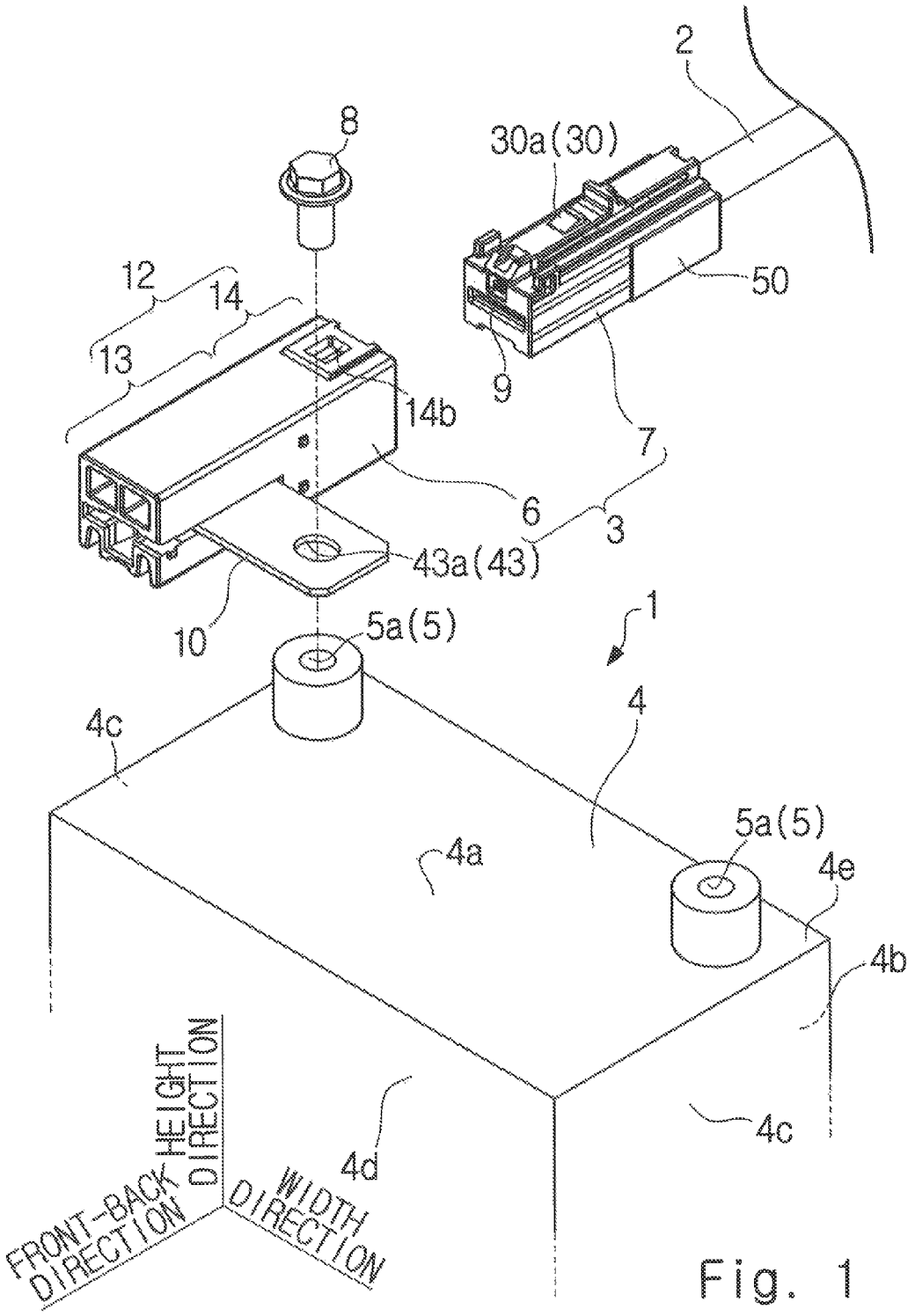
FIG. 1 is an exploded perspective view showing a storage battery, a receptacle connector, and a plug connector (first embodiment)

FIG. 1 shows a storage battery 1 (connection object), an electric cord 2 (wire), and a battery connector 3 (connector).

The storage battery 1 includes a storage battery body 4 (connection object body) having a substantially rectangular parallelepiped shape, and a pair of output terminals 5 (connection terminals) formed on an upper surface 4*a* of the storage battery body 4. The storage battery body 4 has a front surface 4*b*, a pair of side surfaces 4*c*, and a back surface 4*d*. Each output terminal 5 is provided in the vicinity of a corner portion 4*e* between the front surface 4*b* and the corresponding side surface 4*c*. Each output terminal 5 is formed so as to project in a direction orthogonal to the upper surface 4*a* of the storage battery body 4. Each output terminal 5 is provided with a female screw 5*a* for bolting.

The terms "height direction", "width direction", and "front-back direction" will now be defined. The term "height direction" refers to a direction orthogonal to the upper surface 4*a* of the storage battery body 4. In the height direction, a direction in which each output terminal 5 projects is referred to as an upward direction, and a direction opposite to the upward direction is referred to as a downward direction. The term "width direction" refers to a direction orthogonal to each side surface 4*c*. In the width direction, a direction approaching the center of the storage battery 1 is referred to as a width center direction, and a direction apart from the center of the storage battery 1 is referred to as a width anti-center direction. The term "front-back direction" refers to a direction orthogonal to the front surface 4*b* and the back surface 4*d*. In the front-back direction, a direction in which the front surface 4*b* exists when viewed from the back surface 4*d* is referred to as a forward direction, and a direction in which the back surface 4*d* exists when viewed from the front surface 4*b* is referred to as a backward direction. Accordingly, the height direction, the width direction, and the front-back direction are orthogonal to each other.

The electric cord 2 is formed of, for example, a copper wire with a coating which carries a current of about 100 A.

The battery connector 3 is used to detachably connect the electric cord 2 to each output terminal 5 of the storage battery 1. The battery connector 3 includes a receptacle connector 6 (an electric connector, a first connector) and a plug connector 7 (a mating connector, a second connector). The receptacle connector 6 is a connector to be attached to each output terminal 5 of the storage battery 1 with a bolt 8. The plug connector 7 is a connector to be attached to the electric cord 2. The plug connector 7 is mated with the receptacle connector 6, thereby allowing the electric cord 2 to be electrically connected to each output terminal 5 of the storage battery 1.

(Plug Connector 7)

The plug connector 7 includes a plug contact 9 (mating contact) connected to the copper wire of the electric cord 2, and a plug housing 50 that holds the plug contact 9.

(Receptacle Connector 6)

The receptacle connector 6 will be described below with reference to FIGS. 2 to 14. Note that the attachment position of the receptacle connector 6 relative to the storage battery 1 is unambiguously determined. Accordingly, the terms "height direction", "width direction", and "front-back direction", which are defined above with reference to FIG. 1, are also used in the description of the receptacle connector 6. However, the application of the receptacle connector 6 and the attachment position of the receptacle connector 6 relative to the storage battery 1 should not be interpreted in a limited manner by the use of the terms "height direction", "width direction", and "front-back direction" in the description of the receptacle connector 6.

Figure 2:
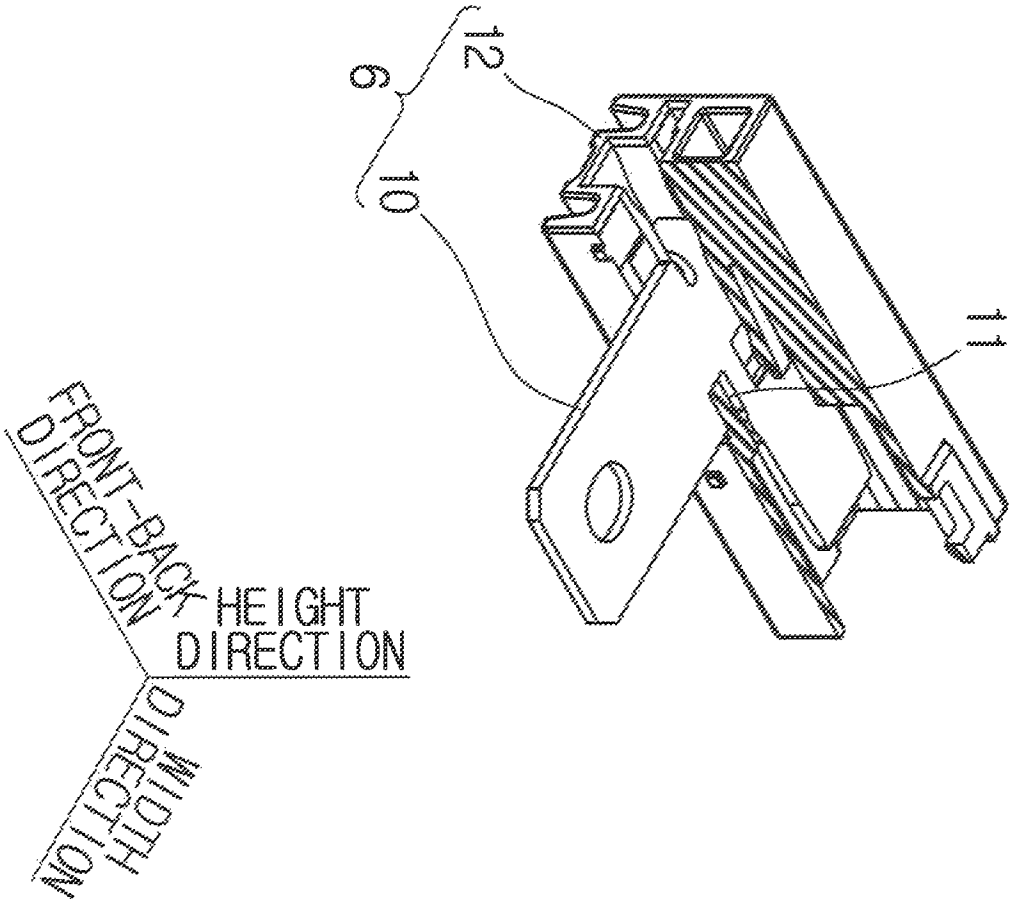
FIG. 2 is a partially cutaway perspective view of the receptacle connector (first embodiment)
Figure 3:
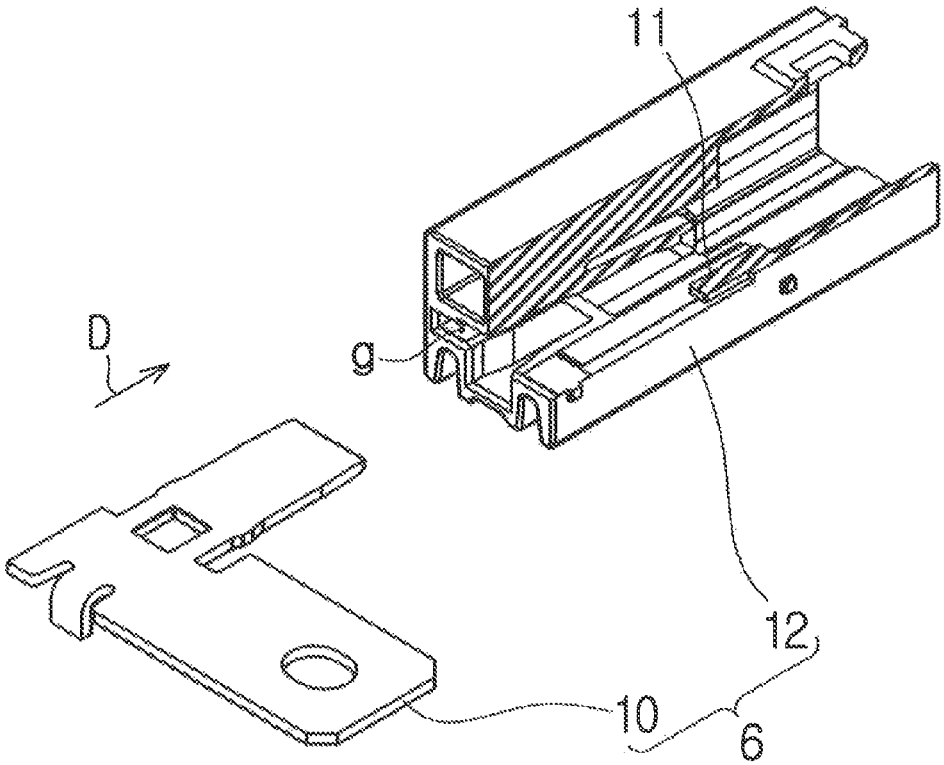
FIG. 3 is an exploded perspective view of the receptacle connector (first embodiment)
Figure 3:
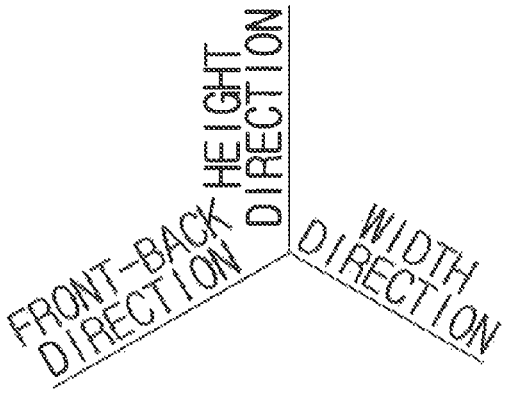

As shown in FIGS. 2 and 3, the receptacle connector 6 includes a receptacle contact 10 (contact) capable of coming into contact with the plug contact 9 (see FIG. 1) of the plug connector 7, and a receptacle housing 12 (housing) having a contact insertion hole 11 into which the receptacle contact 10 is inserted. When the receptacle contact 10 is inserted into the contact insertion hole 11, the receptacle contact 10 is held by the receptacle housing 12. As shown in FIG. 3, in this embodiment, an insertion direction D in which the receptacle contact 10 is inserted into the contact insertion hole 11 of the receptacle housing 12 coincides with the forward direction.

(Receptacle Connector 6: Receptacle Housing 12)

Figure 7:
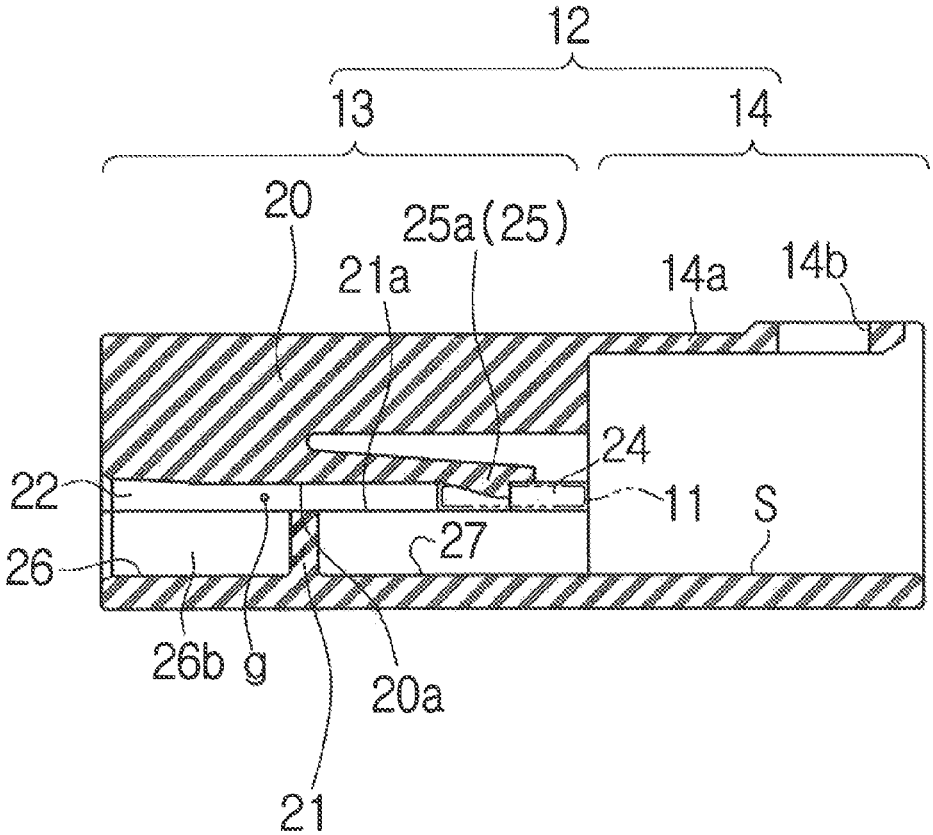
FIG. 7 is a sectional view taken along the line VII-VII of FIG. 5 (first embodiment)
Figure 7:
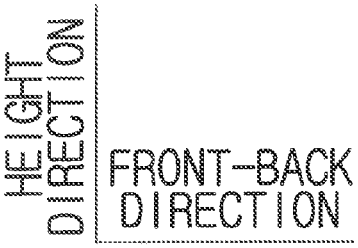
Figure 8:
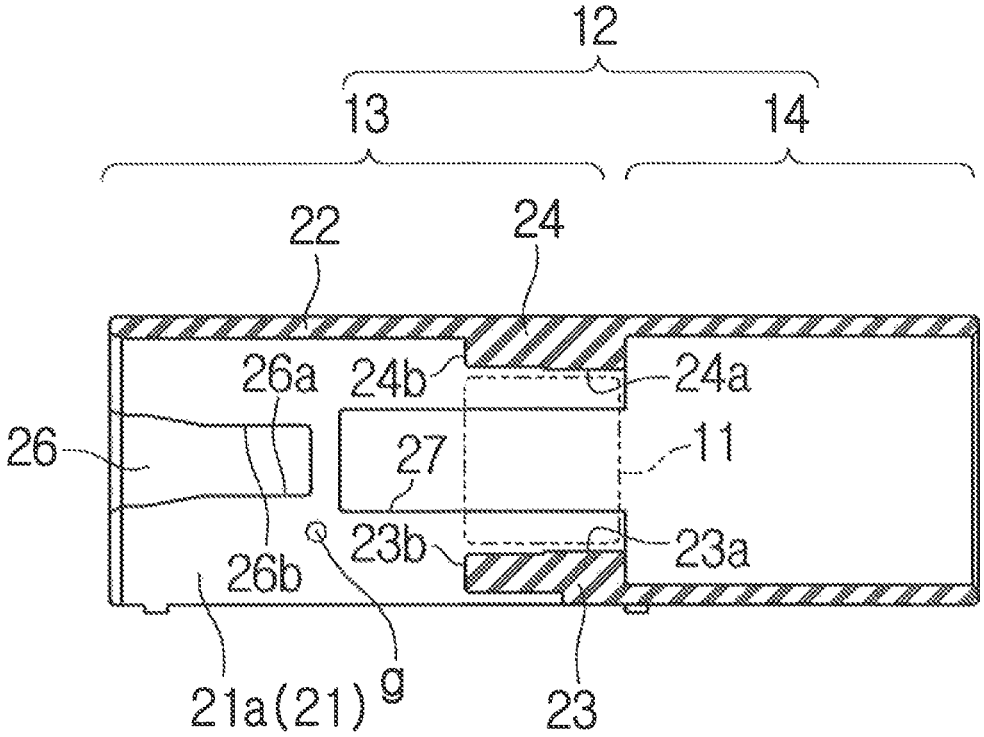
FIG. 8 is a sectional view taken along the line VIII-VIII of FIG. 6 (first embodiment)
Figure 8:
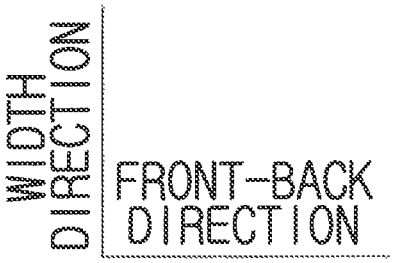

The receptacle housing 12 of the receptacle connector 6 will be described below with reference to FIGS. 4 to 8. FIGS. 7 and 8 illustrate schematic sectional views of the receptacle housing 12, for convenience of explanation.

Figure 5:
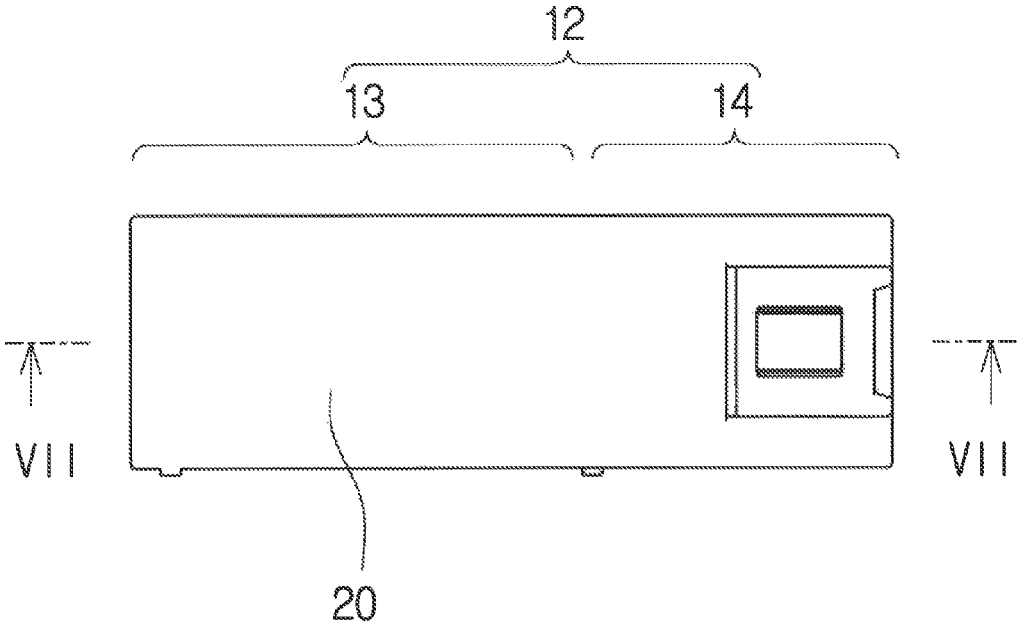
FIG. 5 is a plan view of the receptacle housing (first embodiment)
Figure 5:
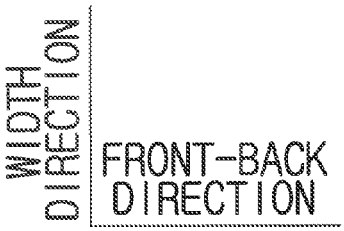

As shown in FIGS. 4 to 6, the receptacle housing 12 has a substantially rectangular parallelepiped shape in appearance which is elongated in the front-back direction. As shown in FIGS. 7 and 8, the receptacle housing 12 includes a housing body 13 and a mating portion 14. The housing body 13 is adjacent to the backward direction side of the mating portion 14. The mating portion 14 is adjacent to the forward direction side of the housing body 13. The receptacle housing 12 is formed so as to have a substantially tubular shape.

As shown in FIGS. 7 and 8, the housing body 13 includes a top plate 20, a base plate 21, a left side plate 22, a right press-fit holding portion 23, a left press-fit holding portion 24, and a lance 25.

The top plate 20 and the base plate 21 are opposed to each other in the height direction. The top plate 20 is located on the upward direction side of the base plate 21, and the base plate 21 is located on the downward direction side of the top plate 20. Between the top plate 20 and the base plate 21, a gap g which is slightly larger than the thickness of the receptacle contact 10 is formed (also see FIG. 6).

The top plate 20 has a lower surface 20*a*. The lower surface 20*a* is a surface opposite to the base plate 21. The lance 25 is formed on the lower surface 20*a*. The lance 25 is used to prevent the receptacle contact 10 from being removed. The lance 25 is formed to extend in a cantilever manner from the lower surface 20*a* of the top plate 20 in the forward direction. A lance claw 25*a* is formed at a free end of the lance 25.

The base plate 21 has an upper surface 21*a*. The upper surface 21*a* is a surface opposite to the top plate 20. The upper surface 21 a has an interference portion insertion groove 26 formed therein. The interference portion insertion groove 26 is formed on the backward direction side of the upper surface 21*a*. The interference portion insertion groove 26 is opened in the upward direction and the backward direction. As shown in FIG. 8, the interference portion insertion groove 26 is formed in such a manner that the dimension in the width direction of the interference portion insertion groove 26 gradually decreases toward the forward direction. The base plate 21 includes a right inner wall surface 26*a* (an inner wall surface, a regulating portion) and a left inner wall surface 26*b* (an inner wall surface, a regulating portion). The right inner wall surface 26*a* is an inner wall surface that defines the width center direction side of the interference portion insertion groove 26. The left inner wall surface 26*b* is an inner wall surface that defines the width anti-center direction side of the interference portion insertion groove 26. The right inner wall surface 26*a* and the left inner wall surface 26*b* face each other. The gap between the right inner wall surface 26*a* and the left inner wall surface 26*b* is therefore gradually narrowed toward the forward direction.

The left side plate 22, the right press-fit holding portion 23, and the left press-fit holding portion 24 are each formed between the top plate 20 and the base plate 21.

As shown in FIG. 8, the left side plate 22 and the left press-fit holding portion 24 define the width anti-center direction side of the gap g. The left side plate 22 is adjacent to the backward direction side of the left press-fit holding portion 24. The left press-fit holding portion 24 is adjacent to the forward direction side of the left side plate 22. The right press-fit holding portion 23 defines the width center direction side of the gap g. The right press-fit holding portion 23 and the left press-fit holding portion 24 are opposed to each other in the width direction.

The right press-fit holding portion 23 includes a right press-fit holding surface 23*a* and a right contact insertion regulating surface 23*b*. The right press-fit holding surface 23*a* is a surface opposite to the left press-fit holding portion 24. The right contact insertion regulating surface 23*b* is a surface that faces in the backward direction.

The left press-fit holding portion 24 has a left press-fit holding surface 24*a* and a left contact insertion regulating surface 24*b*. The left press-fit holding surface 24*a* is a surface opposite to the right press-fit holding portion 23. The left contact insertion regulating surface 24*b* is a surface that faces in the backward direction.

In this embodiment, as indicated by broken lines in FIGS. 7 and 8, the lower surface 20*a* of the top plate 20, the upper surface 21*a* of the base plate 21, the right press-fit holding surface 23*a* of the right press-fit holding portion 23, and the left press-fit holding surface 24*a* of the left press-fit holding portion 24 form the contact insertion hole 11.

As shown in FIG. 7, the lance claw 25*a* of the lance 25 is located in the contact insertion hole 11.

In addition, as shown in FIGS. 7 and 8, a lightening recess 27 is formed, as needed, in the base plate 21.

The mating portion 14 is formed so as to have a substantially rectangular tubular shape and project in the forward direction from the housing body 13. The mating portion 14 provides a mating space S that receives the plug connector 7. A mating top plate 14*a* of the mating portion 14 has a lance locking surface 14*b* on which a lance claw 30*a* of a lance 30 of the plug housing 50 of the plug connector 7 shown in FIG. 1 is caught.

(Receptacle Connector 6: Receptacle Contact 10)

Figure 9:
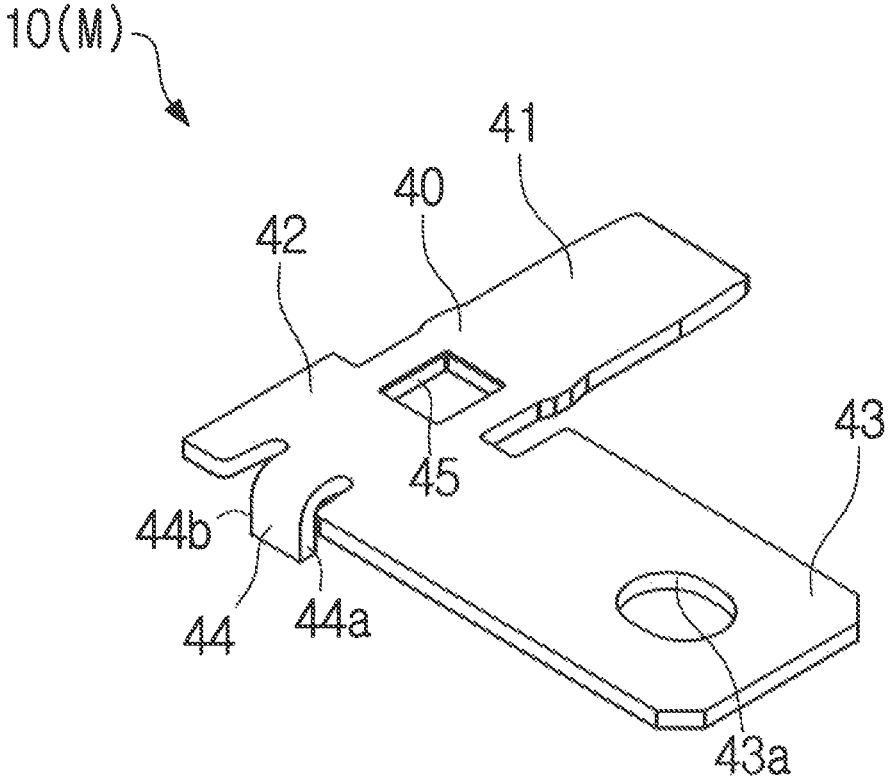
FIG. 9 is a perspective view of the receptacle contact (first embodiment)
Figure 9:
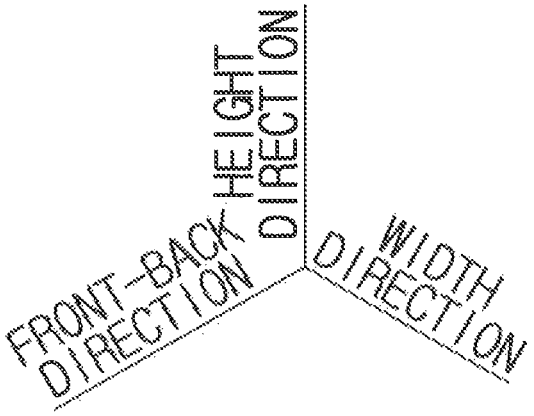
Figure 10:
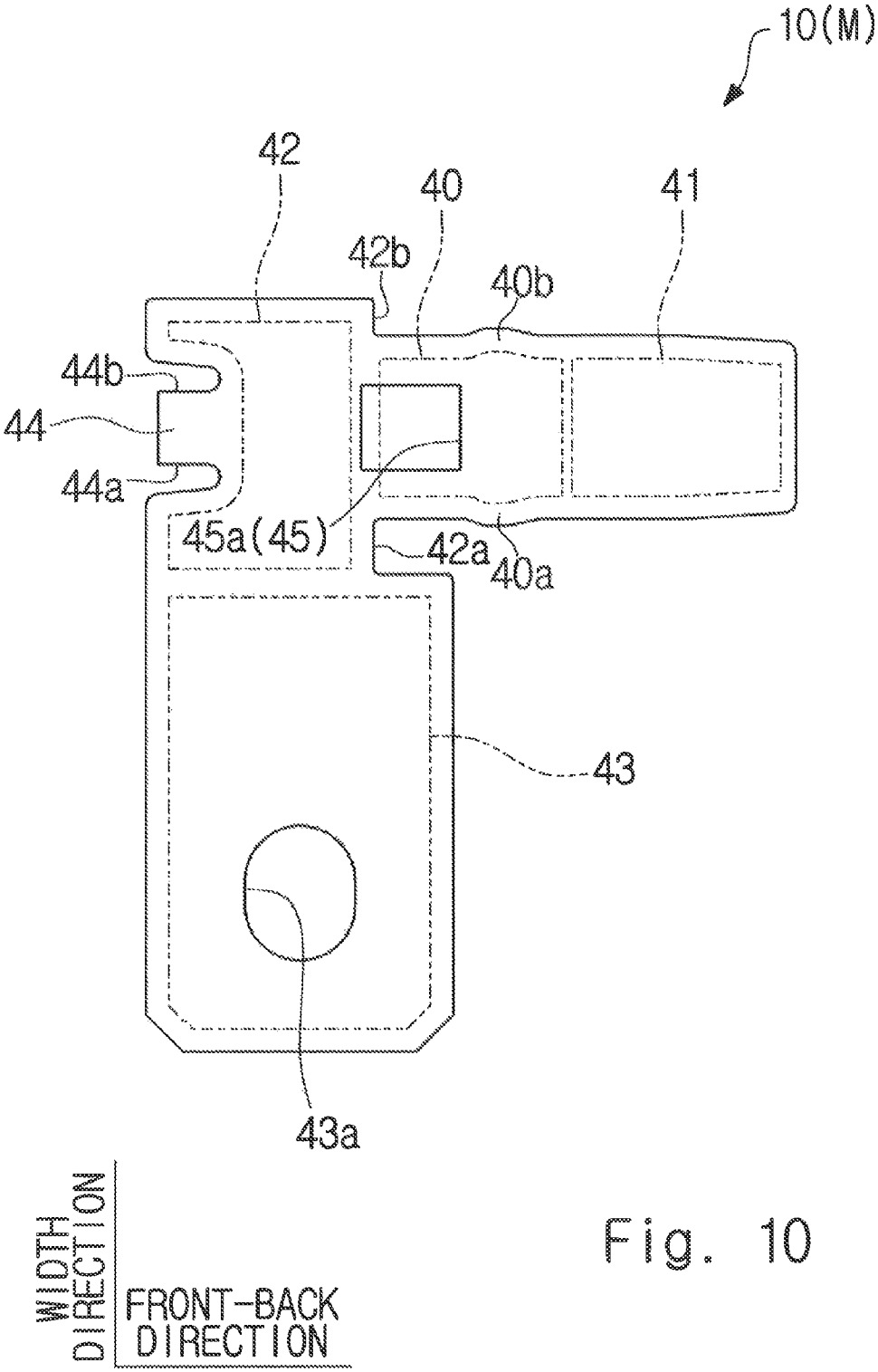
FIG. 10 is a plan view of the receptacle contact (first embodiment)

As shown in FIGS. 9 and 10, the receptacle contact 10 is formed of a metallic plate M which is somewhat thick. The receptacle contact 10 includes a held portion 40, a distal end portion 41, a proximal end portion 42, an orthogonal portion 43, and an interference portion 44. As shown in FIG. 9, the held portion 40, the distal end portion 41, the proximal end portion 42, and the orthogonal portion 43 are flush with each other and the thickness directions thereof are parallel to each other. The thickness directions of the held portion 40, the distal end portion 41, the proximal end portion 42, and the orthogonal portion 43 are parallel to the height direction. The thickness direction of the interference portion 44 is orthogonal to the thickness direction of the proximal end portion 42 and the like. The thickness direction of the interference portion 44 is parallel to the front-back direction. The proximal end portion 42, the held portion 40, and the distal end portion 41 are arranged in this order in the forward direction.

The held portion 40 is a portion that is accommodated in the contact insertion hole 11 of the housing body 13 of the receptacle housing 12 shown in FIG. 8, and is held by the housing body 13 of the receptacle housing 12. As shown in FIG. 10, the held portion 40 includes a right bulging portion 40*a* which bulges in the width center direction, and a left bulging portion 40*b* which bulges in the width anti-center direction. The right bulging portion 40*a* and the left bulging portion 40*b* are formed in the vicinity of the distal end portion 41. The dimension in the width direction of the contact insertion hole 11, which is sandwiched between the right press-fit holding surface 23*a* of the right press-fit holding portion 23 and the left press-fit holding surface 24*a* of the left press-fit holding portion 24 as shown in FIG. 8, is set to be slightly smaller than the dimension in the width direction of the held portion 40 including the right bulging portion 40*a* and the left bulging portion 40*b* shown in FIG. 10.

The distal end portion 41 is a portion that projects in the forward direction from the held portion 40 and is capable of coming into contact with the plug contact 9 (see FIG. 1) of the plug connector 7.

The proximal end portion 42 is a portion that projects in the backward direction from the held portion 40. The proximal end portion 42 has a right shoulder surface 42*a* and a left shoulder surface 42*b*. The right shoulder surface 42*a* is a surface that is located on the width center direction side relative to the held portion 40 and faces in the forward direction. The left shoulder surface 42*b* is a surface that is located on the width anti-center direction side relative to the held portion 40 and faces in the forward direction.

The orthogonal portion 43 is a portion that projects in the width center direction from the proximal end portion 42. The orthogonal portion 43 has a bolt hole 43*a* for bolting.

As shown in FIG. 9, the interference portion 44 is a portion that projects from the proximal end portion 42. The interference portion 44 is inclined and projects in the downward direction relative to the proximal end portion 42. In this embodiment, the interference portion 44 projects from the proximal end portion 42 in such a manner that the thickness direction of the interference portion 44 is substantial orthogonal to the thickness direction of the proximal end portion 42. In other words, the interference portion 44 is formed so as to project in the downward direction from the proximal end portion 42. The interference portion 44 is disposed opposite to the held portion 40 with the proximal end portion 42 interposed therebetween. The thickness direction of the interference portion 44 is parallel to the front-back direction. The interference portion 44 has a right end face 44*a* and a left end face 44*b*. The right end face 44*a* is an end face that faces in the width center direction. The left end face 44*b* is an end face that faces in the width anti-center direction.

Further, the receptacle contact 10 has a lance locking hole 45 formed therein. The receptacle contact 10 has a lance locking surface 45*a* that defines the forward direction side of the lance locking hole 45. The lance locking surface 45*a* is located substantially at the center of the held portion 40 in the front-back direction. In other words, the held portion 40 of the receptacle contact 10 has the lance locking surface 45*a* on which the lance claw 25*a* of the lance 25 is caught.

(Method for Assembling the Receptacle Connector 6)

Next, a method for assembling the receptacle connector 6 will be described with reference to FIGS. 11 and 12.

Figure 12:
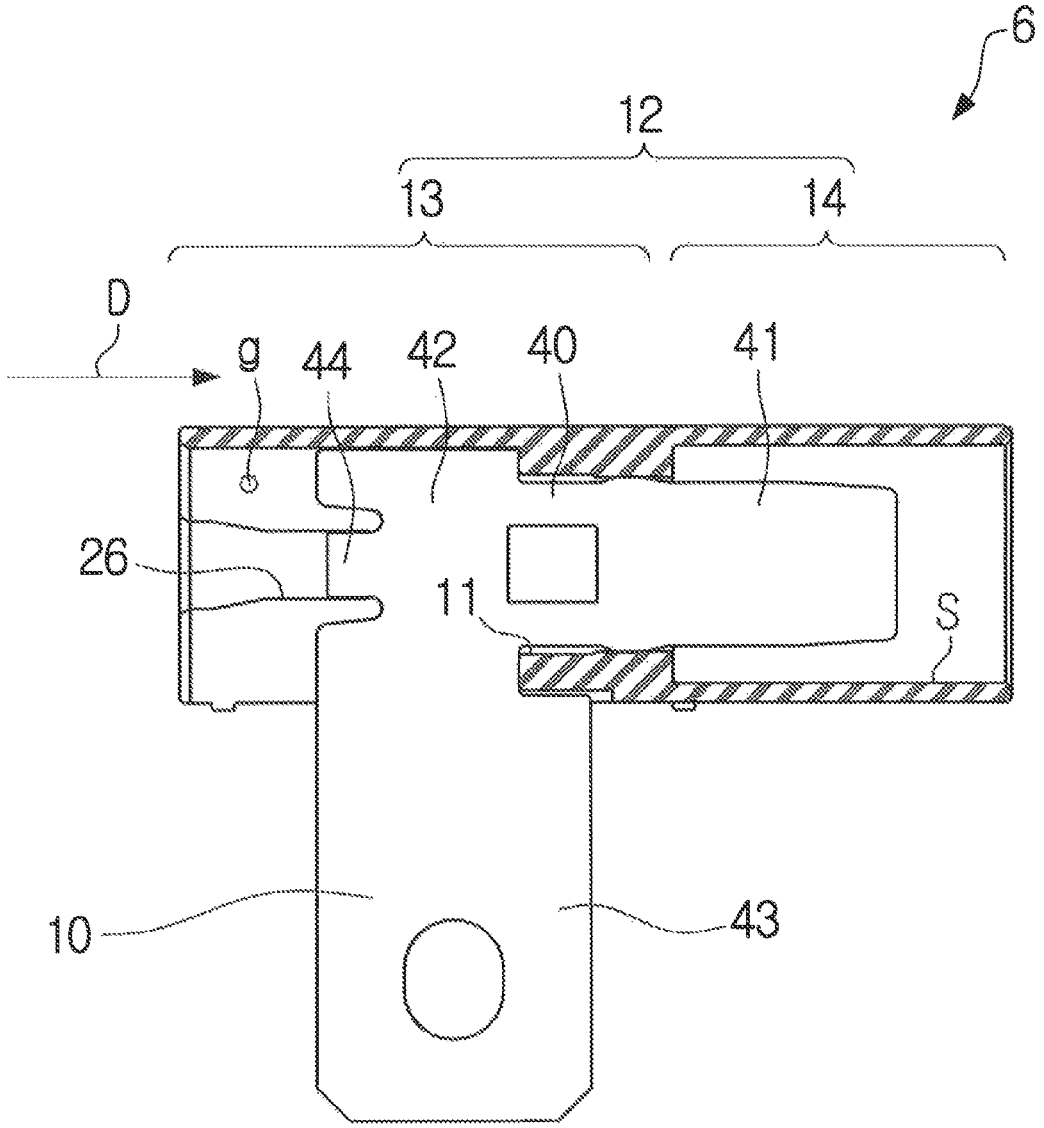
FIG. 12 is a sectional view (corresponding to FIG. 8) showing a state in which the receptacle contact is attached to the receptacle housing (first embodiment)
Figure 12:
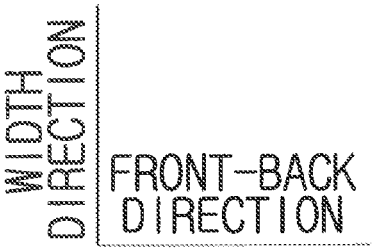

To assemble the receptacle connector 6, as shown in FIG. 12, the receptacle contact 10 is firmly inserted into the gap g of the receptacle housing 12.

As a result, the right shoulder surface 42*a* and the left shoulder surface 42*b* of the proximal end portion 42 of the receptacle contact 10 shown in FIG. 10 are respectively brought into contact with the right contact insertion regulating surface 23*b* of the right press-fit holding portion 23 and the left contact insertion regulating surface 24*b* of the left press-fit holding portion 24 of the receptacle housing 12 shown in FIG. 8, thereby inhibiting further insertion of the receptacle contact 10 into the gap g of the receptacle housing 12.

In the state shown in FIG. 12, when the held portion 40 of the receptacle contact 10 is press-fit into the contact insertion hole 11 of the receptacle housing 12, the held portion 40 of the receptacle contact 10 is held by the receptacle housing 12. Specifically, when the held portion 40 of the receptacle contact 10 is press-fit into the contact insertion hole 11, the held portion 40 gets caught in the receptacle housing 12 in the width direction. As a result, the held portion 40 of the receptacle contact 10 is held by the receptacle housing 12. More specifically, in the state shown in FIG. 12, the right bulging portion 40*a* of the held portion 40 of the receptacle contact 10 shown in FIG. 10 bites into the right press-fit holding surface 23*a* of the right press-fit holding portion 23 of the housing body 13 of the receptacle housing 12 shown in FIG. 8. Similarly, the left bulging portion 40*b* of the held portion 40 of the receptacle contact 10 shown in FIG. 10 bites into the left press-fit holding surface 24*a* of the left press-fit holding portion 24 of the housing body 13 of the receptacle housing 12 shown in FIG. 8. In this manner, the held portion 40 of the receptacle contact 10 is press-fit into the contact insertion hole 11 of the receptacle housing 12, thereby restraining the held portion 40 of the receptacle contact 10 in the front-back direction and the width direction with respect to the receptacle housing 12.

Further, in the state shown in FIG. 12, the interference portion 44 of the receptacle contact 10 is press-fit into the interference portion insertion groove 26 of the receptacle housing 12. Specifically, the right end face 44*a* of the interference portion 44 of the receptacle contact 10 shown in FIG. 10 bites into the right inner wall surface 26*a* of the housing body 13 of the receptacle housing 12 shown in FIG. 8. Similarly, the left end face 44*b* of the interference portion 44 of the receptacle contact 10 shown in FIG. 10 bites into the left inner wall surface 26*b* of the housing body 13 of the receptacle housing 12 shown in FIG. 8. In this manner, the interference portion 44 of the receptacle contact 10 is press-fit into the interference portion insertion groove 26 of the receptacle housing 12, thereby restraining the interference portion 44 of the receptacle contact 10 in the front-back direction and the width direction with respect to the receptacle housing 12.

Figure 11:
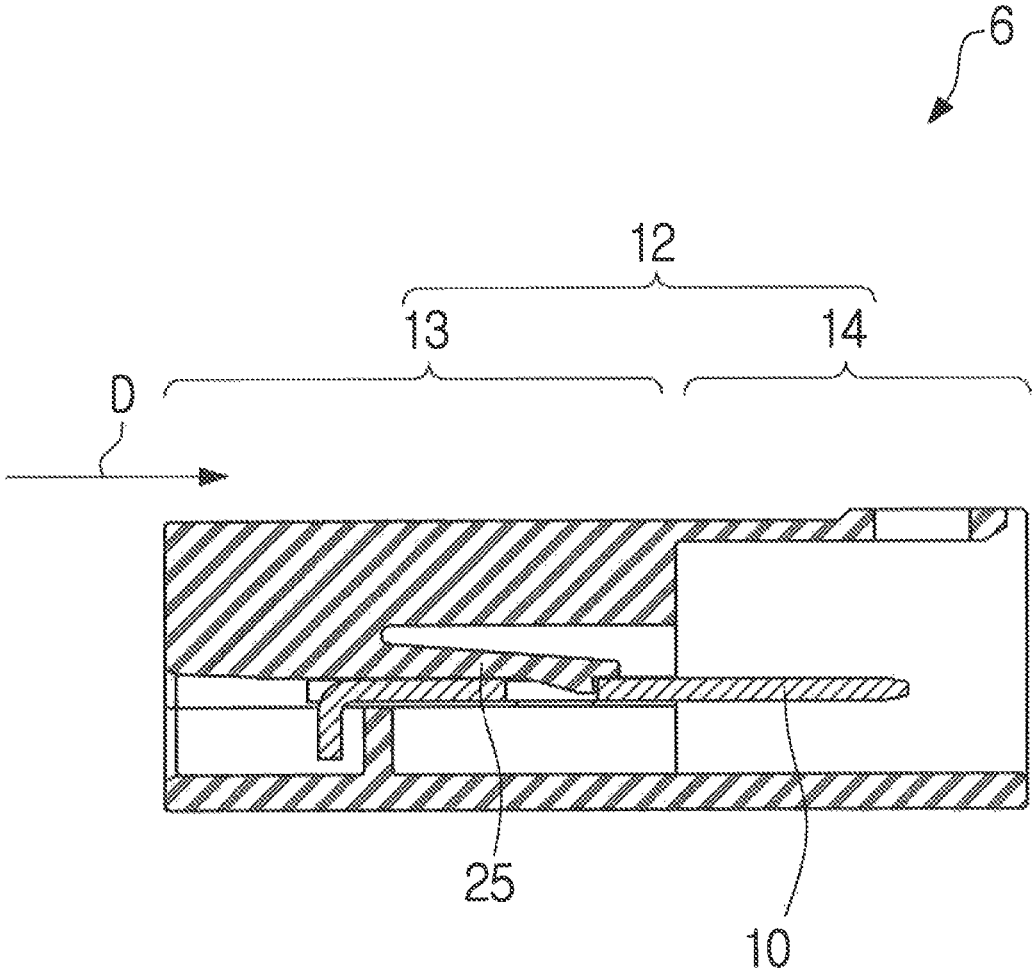
FIG. 11 is a sectional view (corresponding to FIG. 7) showing a state in which the receptacle contact is attached to the receptacle housing (first embodiment)
Figure 11:
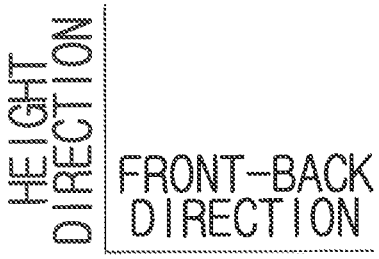

In the state shown in FIG. 11, the receptacle contact 10 is locked by the lance 25 of the housing body 13 of the receptacle housing 12. Specifically, the lance claw 25*a* of the lance 25 of the housing body 13 of the receptacle housing 12 shown in FIG. 7 is inserted into the lance locking hole 45 of the receptacle contact 10 shown in FIG. 10. As a result, the lance claw 25*a* of the lance 25 of the housing body 13 of the receptacle housing 12 shown in FIG. 7 is opposed to the lance locking surface 45*a* of the lance locking hole 45 of the receptacle contact 10 shown in FIG. 10. In this manner, when the lance claw 25*a* of the lance 25 of the housing body 13 of the receptacle housing 12 is caught on the lance locking surface 45*a* of the lance locking hole 45 of the receptacle contact 10, the held portion 40 of the receptacle contact 10 is held by the receptacle housing 12. This avoids the problem that the receptacle housing 12 is relatively removed in the insertion direction D from the receptacle contact 10, which is fixed to the storage battery 1, when the electric cord 2 is pulled in the state shown in FIG. 11.

As shown in FIG. 12, the distal end portion 41 of the receptacle contact 10 is located in the mating space S of the mating portion 14 of the receptacle housing 12. The orthogonal portion 43 of the receptacle contact 10 is located on the width center direction side relative to the receptacle housing 12.

(Usage and Operation of the Receptacle Connector 6)

Next, the usage and operation of the receptacle connector 6 will be described with reference to FIGS. 1, 13, and 14.

To attach the receptacle connector 6 to each output terminal 5 of the storage battery 1 as shown in FIG. 1, the bolt 8 such as M8 is used. Specifically, the bolt 8 is inserted into the bolt hole 43*a* of the orthogonal portion 43 of the receptacle connector 6. In this state, the bolt 8 is screwed into the female screw 5*a* of the output terminal 5 of the storage battery 1.

To mate the plug connector 7 with the receptacle connector 6, the plug connector 7 may be firmly inserted into the mating space S of the mating portion 14 of the receptacle housing 12 of the receptacle connector 6. As a result, the lance claw 30*a* of the lance 30 of the plug housing 50 of the plug connector 7 is caught on the lance locking surface 14*b* of the mating portion 14 of the receptacle housing 12 of the receptacle connector 6, thereby locking the plug connector 7 with respect to the receptacle connector 6. In this manner, when the plug connector 7 is mated with the receptacle connector 6, the plug contact 9 of the plug connector 7 is brought into contact with the distal end portion 41 (also see FIG. 12) of the receptacle contact 10 of the receptacle connector 6. As a result, the electric cord 2 is connected to the output terminal 5 of the storage battery 1.

As shown in FIG. 1, according to the battery connector 3 of this embodiment, the electric cord 2 can be drawn out in the forward direction. That is, in the state where the electric cord 2 is connected to the output terminal 5 of the storage battery 1 by using the battery connector 3, the electric cord 2 extends in the forward direction from the battery connector 3.

As shown in FIG. 1, in the case of attaching the receptacle connector 6 to the output terminal 5 of the storage battery 1, an operator grips the receptacle housing 12 of the receptacle connector 6 with his/her hand and screws the bolt 8 into the female screw 5*a* of the output terminal 5, while holding the position of the receptacle connector 6 with respect to the output terminal 5. In this embodiment, when bolting, the bolt 8 is rotated in the counterclockwise direction for various reasons. In this case, as shown in FIG. 13, a counterclockwise torque T1 is generated in the receptacle contact 10 of the receptacle connector 6 due to the friction between the bolt 8 and the receptacle contact 10. This torque T1 is immediately received by the left press-fit holding surface 24*a* of the left press-fit holding portion 24 of the housing body 13 of the receptacle housing 12 and the right inner wall surface 26*a* of the housing body 13 of the receptacle housing 12. Specifically, when the torque T1 is generated, the left bulging portion 40*b* of the held portion 40 of the receptacle contact 10 is immediately received by the left press-fit holding surface 24*a* of the left press-fit holding portion 24 of the housing body 13 of the receptacle housing 12, and the interference portion 44 of the receptacle contact 10 is received by the right inner wall surface 26*a* of the housing body 13 of the receptacle housing 12. In other words, when the interference portion 44 of the receptacle contact 10 is to be displaced relative to the receptacle housing 12 in the width center direction, the interference portion 44 is received by the right inner wall surface 26*a* of the housing body 13 of the receptacle housing 12. Accordingly, even when the torque T1 is generated, the counterclockwise rotation of the receptacle contact 10 with respect to the receptacle housing 12 is reliably inhibited. Further, since the counterclockwise rotation of the receptacle contact 10 with respect to the receptacle housing 12 is inhibited, the receptacle connector 6 and the plug connector 7 can be subsequently mated with each other without any problem.

On the other hand, in the case of dismounting the receptacle connector 6 from each output terminal 5 of the storage battery 1, the operator grips the receptacle housing 12 of the receptacle connector 6 with his/her hand and loosens and removes the bolt 8 from the female screw 5*a* of the output terminal 5, while holding the position of the receptacle connector 6 with respect to the output terminal 5. Then, as shown in FIG. 14, a clockwise torque T2 is generated in the receptacle contact 10 of the receptacle connector 6 due to the friction between the bolt 8 and the receptacle contact 10. This torque T2 is immediately received by the right press-fit holding surface 23*a* of the right press-fit holding portion 23 of the housing body 13 of the receptacle housing 12 and the left inner wall surface 26*b* of the housing body 13 of the receptacle housing 12. Specifically, when the torque T2 is generated, the right bulging portion 40*a* of the held portion 40 of the receptacle contact 10 is immediately received by the right press-fit holding surface 23*a* of the right press-fit holding portion 23 of the housing body 13 of the receptacle housing 12, and the interference portion 44 of the receptacle contact 10 is received by the left inner wall surface 26*b* of the housing body 13 of the receptacle housing 12. In other words, when the interference portion 44 of the receptacle contact 10 is to be displaced relative to the receptacle housing 12 in the width anti-center direction, the interference portion 44 is received by the left inner wall surface 26*b* of the housing body 13 of the receptacle housing 12. Accordingly, even when the torque T2 is generated, the clockwise rotation of the receptacle contact 10 with respect to the receptacle housing 12 is reliably inhibited.

Figure 13:
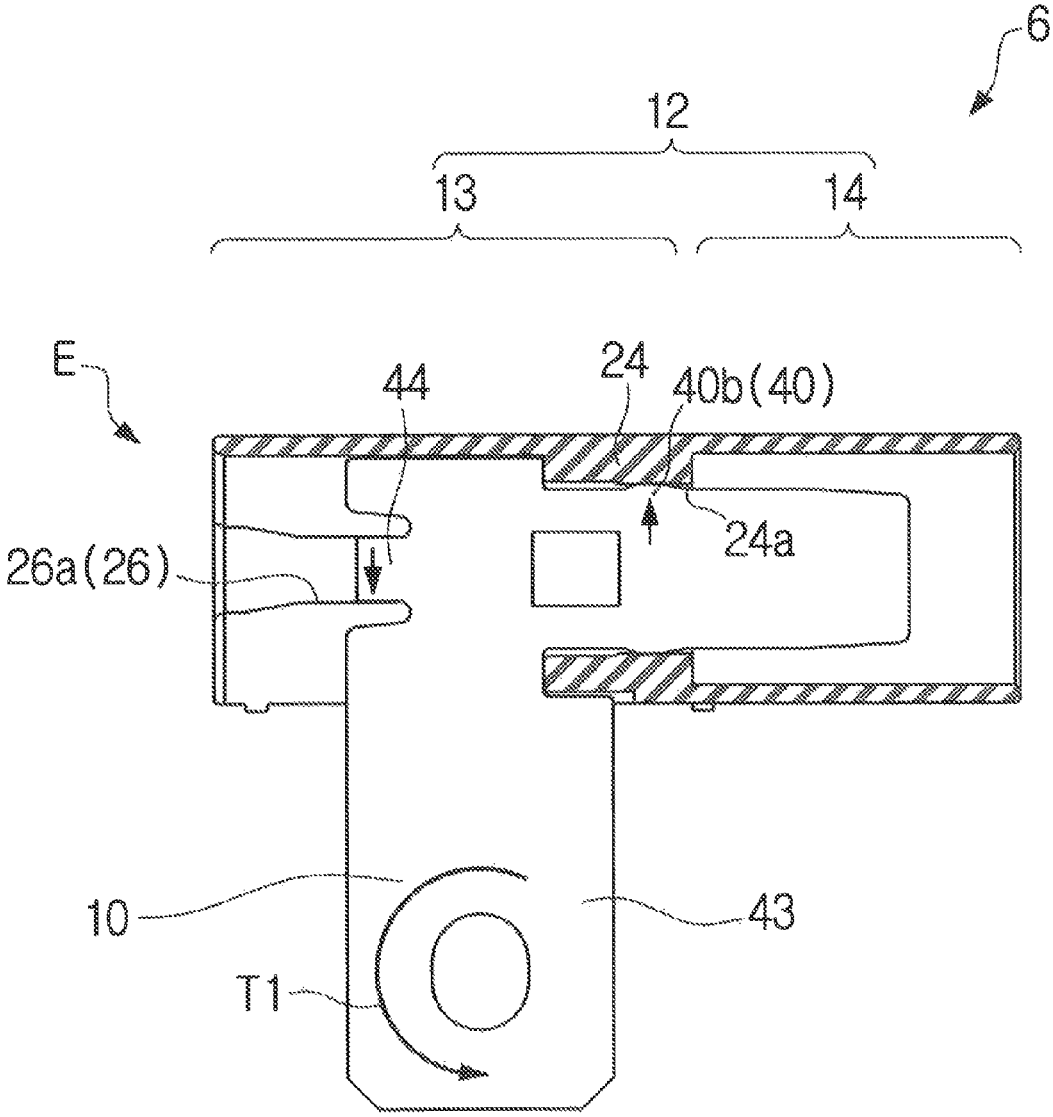
FIG. 13 is a sectional view (corresponding to FIG. 12) of the receptacle connector, which illustrates an operation of the receptacle connector (first embodiment)
Figure 13:
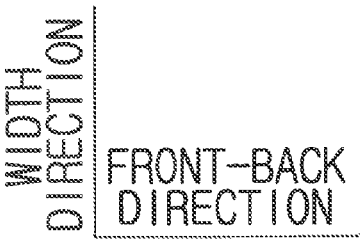
Figure 14:
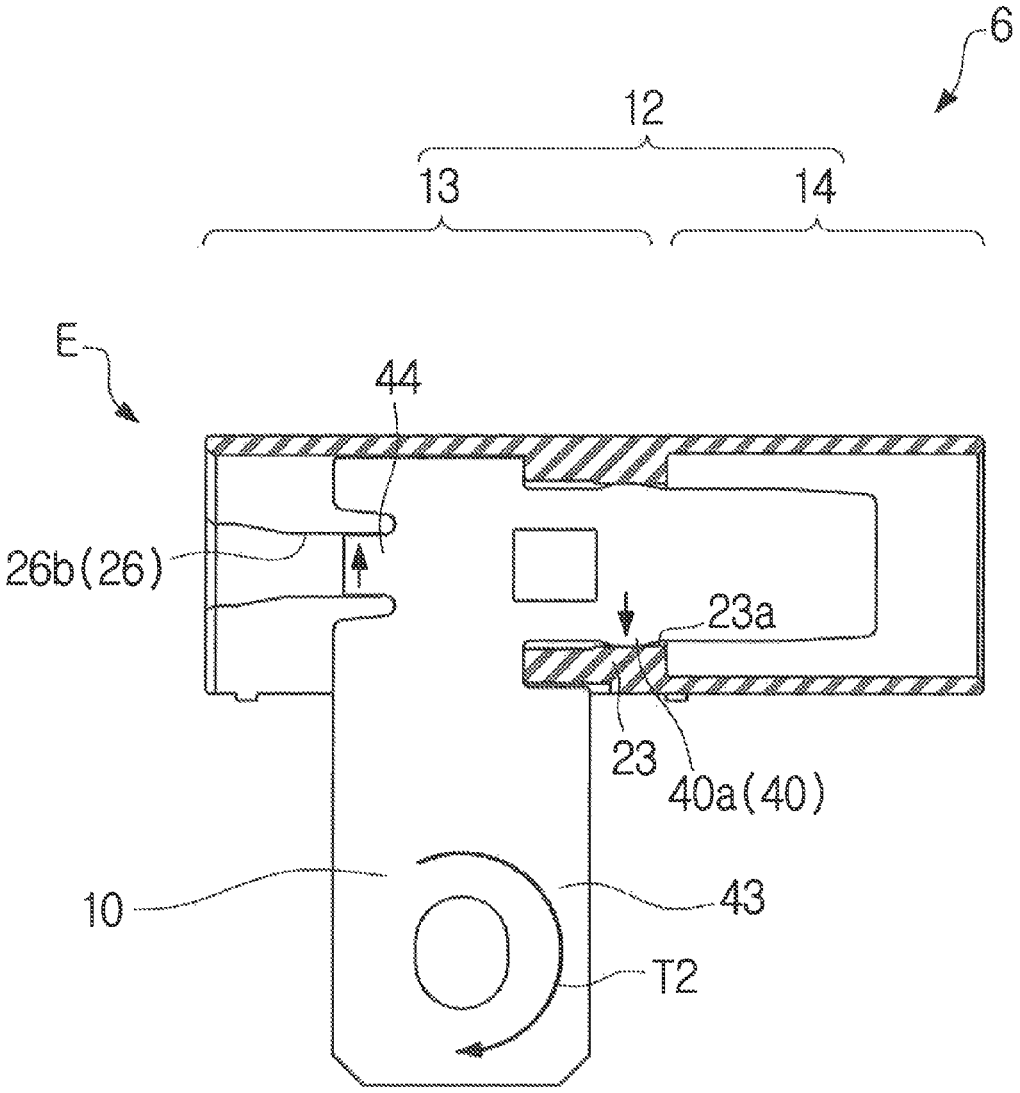
FIG. 14 is a sectional view (corresponding to FIG. 12) of the receptacle connector, which illustrates another operation of the receptacle connector (first embodiment)
Figure 14:
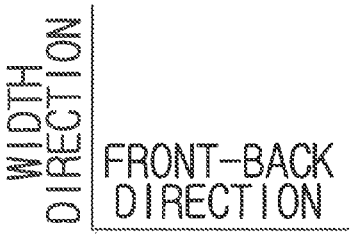

In this embodiment, as shown in FIGS. 13 and 14, the receptacle connector 6 includes a displacement regulating mechanism E that regulates displacement of the proximal end portion 42 of the receptacle contact 10 relative to the receptacle housing 12 in the width center direction or the width anti-center direction. The displacement regulating mechanism E includes the interference portion 44, the right inner wall surface 26*a*, and the left inner wall surface 26*b*. The displacement regulating mechanism E is achieved by the interference portion 44 and at least one of the right inner wall surface 26*a* and the left inner wall surface 26*b*.

The first embodiment described above has the following features.

(1, 2) The receptacle connector 6 (electric connector) includes the receptacle contact 10 (contact) capable of coming into contact with the plug contact 9 (mating contact) of the plug connector 7 (mating connector), and the receptacle housing 12 (housing) having the contact insertion hole 11 into which the receptacle contact 10 is inserted. When the receptacle contact 10 is inserted into the contact insertion hole 11, the receptacle contact 10 is held by the receptacle housing 12. The receptacle contact 10 includes: the held portion 40 that is accommodated in the contact insertion hole 11 and is held by the receptacle housing 12; the distal end portion 41 projecting from the held portion 40 in the insertion direction D in which the receptacle contact 10 is inserted into the contact insertion hole 11, the distal end portion 41 being capable of coming into contact with the plug contact 9 of the plug connector 7; the proximal end portion 42 projecting from the held portion 40 in a direction opposite to the insertion direction D; and the orthogonal portion 43 projecting from the proximal end portion 42 in a direction substantially orthogonal to the insertion direction D. The orthogonal portion 43 has the bolt hole 43*a* for bolting. The receptacle connector 6 further includes the displacement regulating mechanism E that regulates displacement of the proximal end portion 42 relative to the receptacle housing 12 in the width center direction (a direction in which the orthogonal portion 43 projects, a direction substantially orthogonal to the insertion direction D, and a direction different from the insertion direction D). As shown in FIG. 13, the above structure prevents the receptacle contact 10 from rotating relative to the receptacle housing 12 during screwing.

(3) The receptacle contact 10 includes the interference portion 44 projecting from the proximal end portion 42. The receptacle housing 12 has the right inner wall surface 26*a* (regulating portion) that receives the interference portion 44 when the interference portion 44 is to be displaced relative to the receptacle housing 12 in a direction substantially orthogonal to the insertion direction D. The interference portion 44 and the right inner wall surface 26*a* form the displacement regulating mechanism E. According to the above structure, the displacement regulating mechanism E is achieved with a simple structure.

(4) The interference portion 44 is disposed opposite to the held portion 40 with the proximal end portion 42 interposed therebetween. According to the above structure, in the case of bolting, the position of the receptacle contact 10 relative to the receptacle housing 12 can be more reliably maintained. This is because a large distance can be ensured between the held portion 40 and the displacement regulating mechanism E by taking a couple of force into consideration.

(5) The receptacle housing 12 has the interference portion insertion groove 26 in which the interference portion 44 is inserted. The right inner wall surface 26*a*, which is an inner wall surface of the interference portion insertion groove 26, functions as the regulating portion. According to the above structure, the regulating portion can be achieved with a simple structure.

(6) The interference portion 44 is press-fit into the interference portion insertion groove 26. According to the above structure, the interference portion 44 and the right inner wall surface 26*a* are brought into close contact with each other prior to bolting. Accordingly, when bolting, the position of the receptacle contact 10 relative to the receptacle housing 12 can be more reliably maintained.

(7) When the held portion 40 is press-fit into the contact insertion hole 11, the held portion 40 is held by the receptacle housing 12. According to the above structure, the held portion 40 can be held by the receptacle housing 12 with a simple structure.

(8) The receptacle housing 12 includes the lance 25 that prevents removal of the receptacle contact 10. The held portion 40 of the receptacle contact 10 has the lance locking surface 45*a* on which the lance 25 is caught. The held portion 40 is held by the receptacle housing 12 when the lance 25 is caught on the lance locking surface 45*a*. According to the above structure, the held portion 40 can be held by the receptacle housing 12 with a simple structure.

As described above, examples of the structure in which the held portion 40 is held by the receptacle housing 12 include the structure in which the held portion 40 is press-fit into the contact insertion hole 11, and the structure using the lance 25. While the both structures are employed at the same time in the first embodiment described above, only one of the structures may be employed.

In the first embodiment described above, in the case of attaching the receptacle connector 6 to each output terminal 5 of the storage battery 1, the operator screws the bolt 8 into the female screw 5*a* of the output terminal 5, while griping the receptacle housing 12 of the receptacle connector 6 with his/her hand and holding the position of the receptacle connector 6 with respect to the output terminal 5. However, it is not necessarily required to grip the receptacle housing 12 of the receptacle connector 6 with a hand. The position of the receptacle connector 6 with respect to the output terminal 5 can also be maintained when the receptacle connector 6 physically interferes with the side surfaces 4*c* of the storage battery body 4 of the storage battery 1.

(Second Embodiment)

Figure 15:
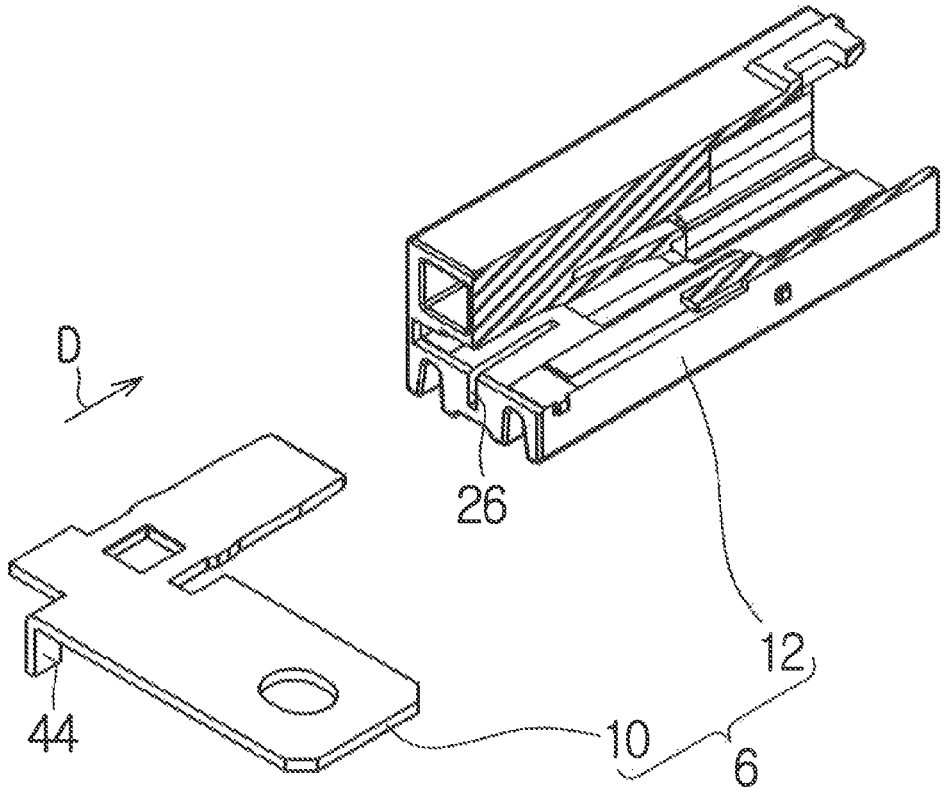
FIG. 15 is an exploded perspective view of a receptacle connector (second embodiment)
Figure 15:
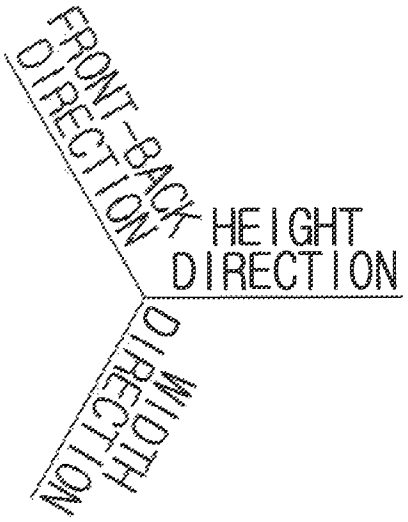

Next, a second embodiment of the present invention will be described with reference to FIG. 15. Here, differences between this embodiment and the first embodiment will be mainly described, while a repeat of previous descriptions is omitted. Components of this embodiment corresponding to the components of the first embodiment described above are denoted by the same reference numerals as those of the first embodiment as a rule.

In this embodiment, the interference portion 44 is formed so as to be orthogonal to the width direction. The receptacle housing 12 has the interference portion insertion groove 26 into which the interference portion 44 is press-fit. In this embodiment, the interference portion 44 and the interference portion insertion groove 26 are located substantially at the center of the receptacle housing 12 in the width direction.

(Third Embodiment)

Figure 16:
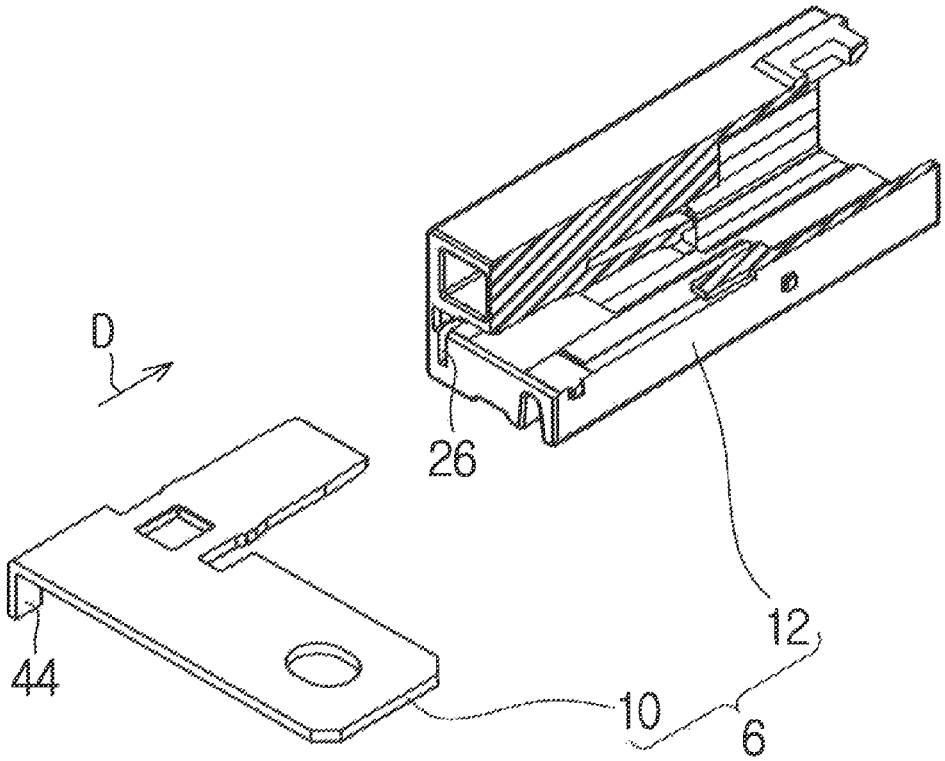
FIG. 16 is an exploded perspective view of a receptacle connector (third embodiment)
Figure 16:
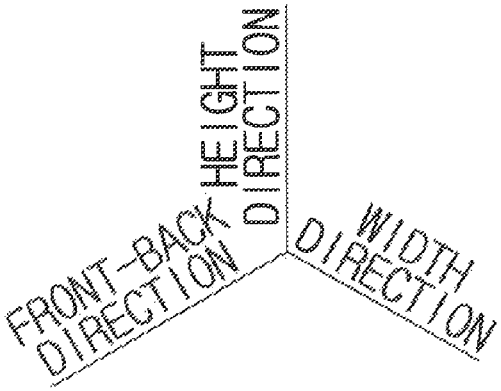
Figure 17:
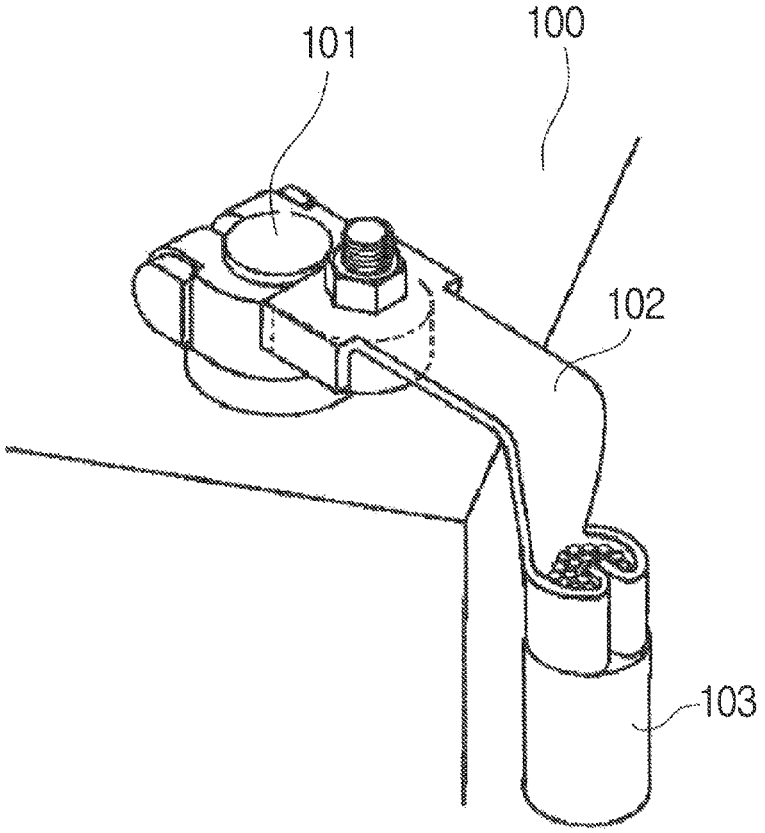
FIG. 17 is a view corresponding to FIG. 1 of Patent Literature 1.

Next, a third embodiment of the present invention will be described with reference to FIG. 16. Here, differences between this embodiment and the first embodiment will be mainly described, while a repeat of previous descriptions is omitted. Components of this embodiment corresponding to the components of the first embodiment described above are denoted by the same reference numerals as those of the first embodiment as a rule.

In this embodiment, the interference portion 44 is formed so as to be orthogonal to the width direction. The receptacle housing 12 has the interference portion insertion groove 26 into which the interference portion 44 is press-fit. In this embodiment, the interference portion 44 and the interference portion insertion groove 26 are placed on the width anti-center direction side of the receptacle housing 12.

This application is based upon and claims the benefit of priority from Japanese patent application No. 2012-195355, filed on Sep. 5, 2012, the disclosure of which is incorporated herein in its entirety by reference.

REFERENCE SIGNS LIST

1 STORAGE BATTERY
2 ELECTRIC CORD
3 BATTERY CONNECTOR
4 STORAGE BATTERY BODY
4*a* UPPER SURFACE
4*b* FRONT SURFACE
4*c* SIDE SURFACE
4*d* BACK SURFACE
4*e* CORNER PORTION
5 OUTPUT TERMINAL
5*a* FEMALE SCREW
6 RECEPTACLE CONNECTOR (ELECTRIC CONNECTOR)
7 PLUG CONNECTOR (MATING CONNECTOR)
8 BOLT
9 RECEPTACLE CONTACT (MATING CONTACT)
10 RECEPTACLE CONTACT (CONTACT)
11 CONTACT INSERTION HOLE
12 RECEPTACLE HOUSING (HOUSING)
13 HOUSING BODY
14 MATING PORTION
14*a* MATING TOP PLATE
14*b* LANCE LOCKING SURFACE
20 TOP PLATE
20*a* LOWER SURFACE
21 BASE PLATE
21*a* UPPER SURFACE
22 LEFT SIDE PLATE
23 RIGHT PRESS-FIT HOLDING PORTION
23*a* RIGHT PRESS-FIT HOLDING SURFACE
23*b* RIGHT CONTACT INSERTION REGULATING SURFACE
24 LEFT PRESS-FIT HOLDING PORTION
24*a* LEFT PRESS-FIT HOLDING SURFACE
24*b* LEFT CONTACT INSERTION REGULATING SURFACE
25 LANCE
25*a* LANCE CLAW
26 INTERFERENCE PORTION INSERTION GROOVE
26*a* RIGHT INNER WALL SURFACE (REGULATING PORTION)
26*b* LEFT INNER WALL SURFACE (REGULATING PORTION)
27 LIGHTENING RECESS
30 LANCE
30*a* LANCE CLAW
40 HELD PORTION
40*a* RIGHT BULGING PORTION
40*b* LEFT BULGING PORTION
41 DISTAL END PORTION
42 PROXIMAL END PORTION
42*a* RIGHT SHOULDER SURFACE
42*b* LEFT SHOULDER SURFACE
43 ORTHOGONAL PORTION
43*a* BOLT HOLE
44 INTERFERENCE PORTION
44*a* RIGHT END FACE
44*b* LEFT END FACE
45 LANCE LOCKING HOLE
45*a* LANCE LOCKING SURFACE
50 PLUG HOUSING
g GAP
D INSERTION DIRECTION
E DISPLACEMENT REGULATING MECHANISM
M METALLIC PLATE
S MATING SPACE
T1 TORQUE
T2 TORQUE

The invention claimed is:

1. An electric connector comprising:

a contact capable of coming into contact with a mating contact of a mating connector; and a housing for an electric connector having a contact insertion hole into which the contact is inserted, the contact being held by the housing when the contact is inserted into the contact insertion hole, wherein the contact comprises:

a held portion that is accommodated in the contact insertion hole and is held by the housing;

a distal end portion projecting from the held portion in an insertion direction in which the contact is inserted into the contact insertion hole, the distal end portion being capable of coming into contact with the mating contact of the mating connector;

a proximal end portion projecting from the held portion in a direction opposite to the insertion direction; and an orthogonal portion projecting from the proximal end portion in a direction substantially orthogonal to the insertion direction, the orthogonal portion has a bolt hole for bolting, and the electric connector further comprises a displacement regulating mechanism that regulates displacement of the proximal end portion relative to the housing in a direction different from the insertion direction.

2. The electric connector according to claim 1, wherein the displacement regulating mechanism regulates displacement of the proximal end portion relative to the housing in a direction substantially orthogonal to the insertion direction.

3. The electric connector according to claim 2, wherein the contact includes an interference portion projecting from the proximal end portion, the housing includes a regulating portion that receives the interference portion when the interference portion is displaced relative to the housing in a direction substantially orthogonal to the insertion direction, and the interference portion and the regulating portion form the displacement regulating mechanism.

4. The electric connector according to claim 3, wherein the interference portion is disposed opposite to the held portion with the proximal end portion interposed therebetween.

5. The electric connector according to claim 3, wherein the housing has an interference portion insertion groove in which the interference portion is inserted, and an inner wall surface of the interference portion insertion groove functions as the regulating portion.

6. The electric connector according to claim 5, wherein the interference portion is press-fit into the interference portion insertion groove.

7. The electric connector according to claim 1, wherein the held portion is press-fit into the contact insertion hole, thereby being held by the housing.

8. The electric connector according to claim 1, wherein the housing includes a lance that prevents removal of the contact, a lance locking surface formed on the held portion of the contact, the lance being caught on the lance locking surface, and the lance is caught on the lance locking surface, thereby allowing the held portion to be held by the housing.

* * * * *